United States Patent [19]

Hahn et al.

[11] 4,175,617

[45] Nov. 27, 1979

[54] SKEWED TURN COILED TUBE HEAT EXCHANGER FOR REFRIGERATOR EVAPORATORS

[75] Inventors: Thomas M. Hahn, Jeffersontown; Ivar Lohmus, Louisville; David E. Oakley, Fairdale, all of Ky.

[73] Assignee: General Electric Company, Louisville, Ky.

[21] Appl. No.: 864,367

[22] Filed: Dec. 27, 1977

[51] Int. Cl.[2] ..... F28D 7/02; F28F 1/38

[52] U.S. Cl. ..... 165/122; 62/419; 72/137; 165/163; 165/172; 165/DIG. 13

[58] Field of Search ..... 62/419; 165/122, 163, 165/DIG. 13, 172; 72/137; 140/89

[56] References Cited

U.S. PATENT DOCUMENTS

| | | | |
|---|---|---|---|
| 1,867,605 | 7/1932 | Thorn | 165/172 |
| 2,056,862 | 10/1936 | Markley, Jr. | 165/172 |
| 2,771,934 | 11/1956 | Payne | 165/172 |
| 2,963,779 | 12/1960 | Mosgard-Jensen | 165/172 |
| 3,294,162 | 12/1966 | Loehlein et al. | 165/182 |
| 3,335,790 | 8/1967 | Aranyi et al. | 165/163 |
| 3,766,976 | 10/1973 | Gelbard et al. | 62/419 |
| 3,845,637 | 11/1974 | Shepherd | 62/419 |
| 4,073,045 | 2/1978 | Margen et al. | 165/172 |
| 4,099,555 | 7/1978 | Margen et al. | 165/172 |

FOREIGN PATENT DOCUMENTS

| | | | |
|---|---|---|---|
| 1509710 | 5/1978 | United Kingdom | 165/172 |

*Primary Examiner*—Sheldon Richter
*Attorney, Agent, or Firm*—Frederick P. Weidner; Radford M. Reams

[57] ABSTRACT

A heat exchanger for refrigerator evaporators of the type consisting of helically coiled refrigerant-carrying tubing with radially inward extending fins formed along the length of the coiled tubing, with the air to be refrigerated directed across the axis of the coil turns. The coil turns are skewed from the helix angle to expose a greater proportion of the fins into the air flow path between the coil turns so as to increase the air flow contact with the fins. The skewing is created by relatively offsetting opposite portions of the coil turns along the air flow path across the helical coil to increase the obliqueness of a portion of each coil turn with respect to the direction of air flow. The tube coil includes sections folded into a side-by-side relationship, with the skew direction of the coil sections placed in reverse orientations to increase the length of the flow path of the air circulated through the coils and to position gaps between each of the coil turns in either section opposite the areas in the other coil section occupied by radial fins.

9 Claims, 9 Drawing Figures

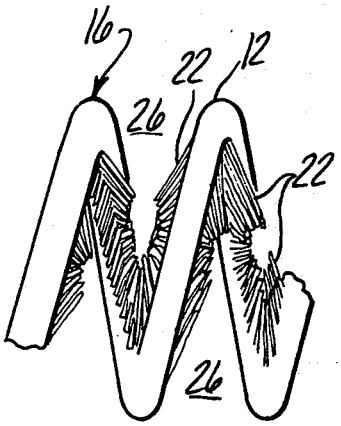
PRIOR ART
Fig-5
Fig-6
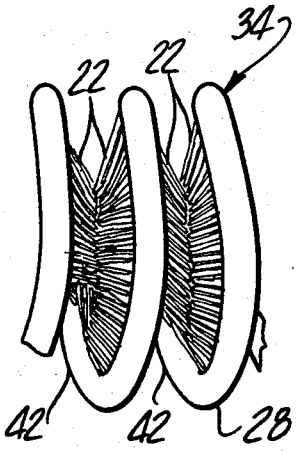
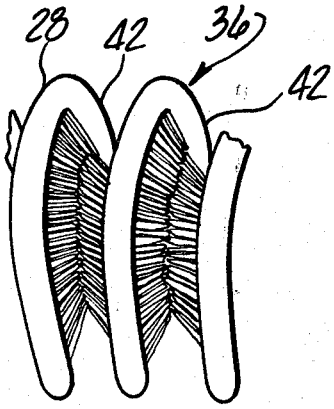
Fig-7

SKEWED TURN COILED TUBE HEAT EXCHANGER FOR REFRIGERATOR EVAPORATORS

BACKGROUND DISCUSSION

U.S. Pat. No. 3,766,976 discloses a heat exchanger for refrigerator evaporators in which tubing is wound in a circular or roughly elliptical helix and along which is formed an array of fins extending radially inward from the tube windings in the coil to enhance the transfer of heat of the tube coil with the air circulated across the coil. The coil is formed in a pair of sections, placed in side-by-side relationship in a compartment provided within the refrigerant cabinet, and air to be refrigerated is directed over the coils in a direction transverse to the axis of the coils. The air passes between the turns of the windings over some of the fins, such that the refrigerant circulated within the tubing absorbs heat and cools the air.

As discussed in detail in that patent, this heat exchanger configuration produces efficient heat transfer, while being relatively resistant to frost blockage and can be manufactured at low cost.

In addition the absence of external fins allows ready handling of the unit during assembly without likelihood of damaging the relatively fragile fins.

While evaporators of this type have come into use in recent years, the traditional heat exchanger for these applications comprised a plate-on-tube type heat exchanger in which loops of refrigerant-carrying tubing are joined by an array of parallel fins. The air to be refrigerated is passed over the tubing and between the fins to cause the refrigerant to absorb heat from the air and refrigerate the air. In this configuration, air flow is directed in a parallel direction to the tubing fins.

In both heat exchanger configurations, the fins are of course provided to enhance the transfer of heat between the air and the heat exchanger tubing carrying the refrigerant. The fins are of relatively low thermal mass and great surface area and are so able to rapidly absorb heat and conduct it into the tubing. In the plate type heat exchanger, the air may be directed in a parallel direction to the fins as noted and good air flow is afforded over the fin structure and is well distributed across the fin array. The plate-on-tube design, as noted in the specification of the above-referenced patent, has the advantage that the fins are relatively closely disposed and subject to ice bridging and are somewhat more costly to manufacture.

While the coiled tube evaporator is highly successful, several factors in regards to the mode of air contact with the fins could allow improved efficiency of the unit.

Firstly, the fins extend radially inward from the tube windings and the air flow being at a direction transverse to the coil axis, the leading section of each turn of the coil shadows a substantial proportion of the fins extending radially inward from the turn section. That is, it blocks the air flow from passing over the portions of the fins closely adjacent the section of the tube.

In the particular design described in the above-referenced patent, the fins extend radially inward, but there is a central opening between opposing fins in each turn to prevent total ice blockage. The opening is resistant to total bridging by ice build-up due to the relatively large size of the opening. However, this opening falls into the gap between windings such that the air tends to bypass the shadowed portions of the fins and pass through the central region intermediate the fin array to further reduce the degree of contact with the fins.

In addition, the air flow is more nearly parallel to the direction of the array of the fins since the tube windings are at a relatively steep angle with respect to the coil axis, which causes shadowing of the fins by other fins in the array.

The relatively steep angle of the tubing coil turns with respect to the coil axis for closely wound coils also creates gaps between the coil windings which, when viewed in the direction of air flow, are unoccupied by fins. This allows a substantial proportion of the air to pass over the coil windings without passing over any fins, to further degrade the efficiency of heat transfer.

While the obliqueness of the coil turns to the direction of the air flow could be increased by increasing the helix angle or the angle at which the tubing is wound into the helix, the helical angle is generally determined by the number of coil turns and the available space within which the coil is to be mounted.

It is accordingly an object of the present invention to provide an improved tube coil type heat exchanger in which the air flow contact with the radially extending fins in passing across the coils is increased.

It is yet another object of the present invention to provide such a coiled tube heat exchanger in which the proportion of the air flow passing between the gaps in the coil windings without contacting the fin array is reduced.

It is still another object of the present invention to provide such a coiled tube heat exchanger of improved efficiency without increasing substantially the manufacturing costs to preserve the advantages of the coiled tube configuration while improving its performance.

It is still a further object of the present invention to reduce the degree of shadowing by the leading portions of the tube windings and by the fins in the array which increases the proportion of air flow in contact with the fin array.

It is yet another object of the present invention to provide a coiled tube evaporator with an increased air flow contact with the fin array which does not substantially increase the space required to house the evaporator.

SUMMARY OF THE INVENTION

These and other objects of the present invention, which will become apparent upon a reading of the following specification and claims, are accomplished by offsetting opposite portions of the turns of a coiled tube evaporator along the direction of the air flow across the coil such that the resultant skewing of the coil turns disposes portions thereof with increased obliquity. This improves the angle of the attack of the air flow through the fin array and exposes a greater part of the fin array surfaces within the spaces between the coil windings presented to the air flow in passing across the coil.

The coil is formed in side-by-side sections which are reversely wound with respect to each other such that the angle of the oppositely skewed windings produces a herringbone pattern which increases the path length of the air flow in passing across both coil sections. In addition, the reverse winding positions finless gaps between the coil windings in each coil section opposite regions occupied by fins to further eliminate gaps through the side-by-side coil section combination through which air may flow without contacting the fin surfaces.

The offsetting of the coil turn portions results in a modest increase in the length of the coil while greatly increasing the proportion of fins encountered by the air in flowing across the coils, while the air flow across the fin array enhances the overall heat coefficient between the air and the fins in the array.

DESCRIPTION OF THE DRAWINGS

FIG. 5 is an enlarged front view of a conventionally wound coil heat exchanger.

FIG. 6 is an enlarged view of a portion of the coil section from the direction of the arrows 6—6 in FIG. 2.

FIG. 7 is a view of a portion of the coil sections from the directions of the arrows 7—7 in FIG. 2.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
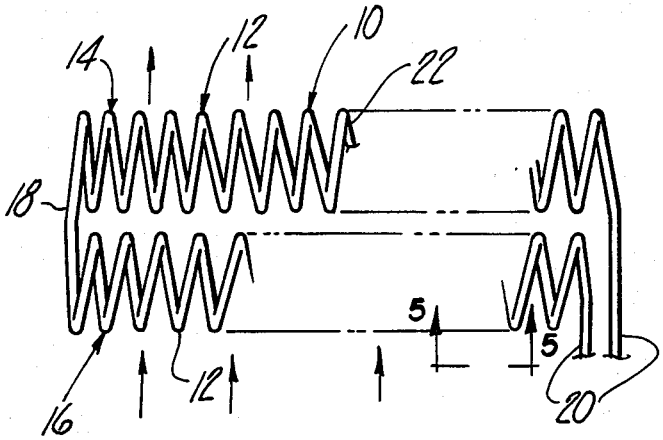
Fig-1 Prior Art
FIG. 1 is a simplified plan view of the coiled tube heat exchanger of the conventional design.

Referring to the drawings and particularly to FIG. 1, a coiled tube evaporator 10 according to the above-referenced U.S. patent is depicted in simplified form. In this configuration, the tubing 12 within which the refrigerant is circulated is wound into helical coil sections 14 and 16, both of which are wound in the same direction. An intermediate section 18 of the tubing interconnects both coil sections such that the refrigerant is circulated through both coil sections 14 and 16.

The helical angle of both coil sections 14 and 16 is the same and is determined by the lead of the helix. The tube thus is wound at a constant inclination to the axis of the helix in accordance with conventional design. Such coils being wound with a constant helix angle, there is a resultant symmetrical disposition of each of the windings with respect to the direction of air flow indicated by the arrows in FIG. 1.

The tube 12 is adapted to carry refrigerant received from the condenser via connections with lines 20.

The tube 12 is provided with a fin array comprising fins 22 (FIG. 5) which extend inwardly along the general direction of the coil radius of the tube 12 at the point whereat each fin is attached to thus be directed toward the interior of each of the coil sections 14 and 16. The fins 22 are formed from a flange integral with the tube 12 and are split from the flange and bent to provide a fanning of the fins 22 to insure that they are not aligned in the array.

Accordingly, a fin array is provided by the radially inwardly extending fins 22 along the length of the tube 12.

Figure 3:
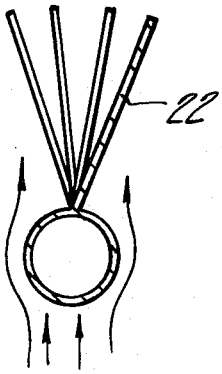
FIG. 3 is a view of a section through the coil tubes shown in FIGS. 1 and 2.

As indicated by the arrows in FIG. 3, the tubing 12 tends to shadow the root sections of the fins 22 since the leading portion of the tube 12 is interposed between the fins 22 and the air flow into the coil sections 14 and 16.

In addition, as seen in FIG. 5, the inclination of the fins 22 and the positioning of the coil turns is such that opposed very shallow roughly conical regions are established by the fin array which leave interposed gaps 26 at the top and bottom of the coil sections as viewed in the direction from which the air flow occurs. These gaps are not occupied by fins in the fin array and thus allow air flow through the coils without coming into contact with the fin array or even the tubing 12 surfaces.

Figure 2:
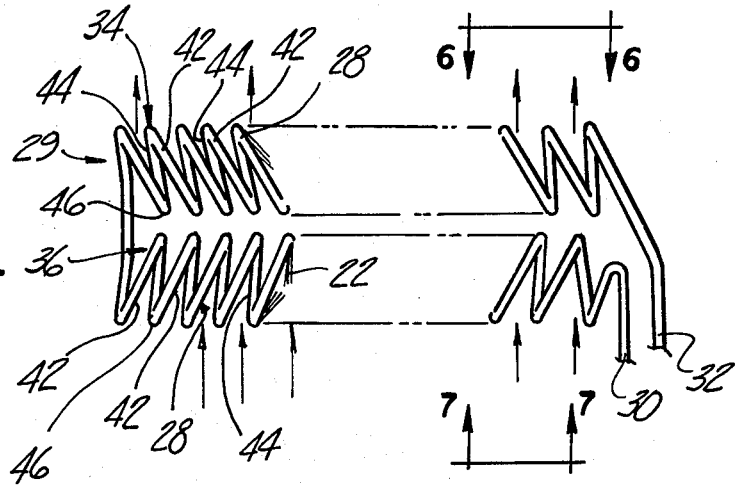
FIG. 2 is a simplified plan view of a skewed coil heat exchanger according to the present invention.

Referring to FIG. 2, the skewed coil heat exchanger 29 similarly includes a helically coiled tubing 28 having spaced coil turns, and within which is circulated the refrigerant via connections 30 and 32. In similar fashion, the coil is provided in two different coil sections 34 and 36 which are positioned in side-by-side relationship. However, the respective coil sections 34 and 36 are oriented such as to be reversely wound for a reason to be described hereinafter.

Figure 4:
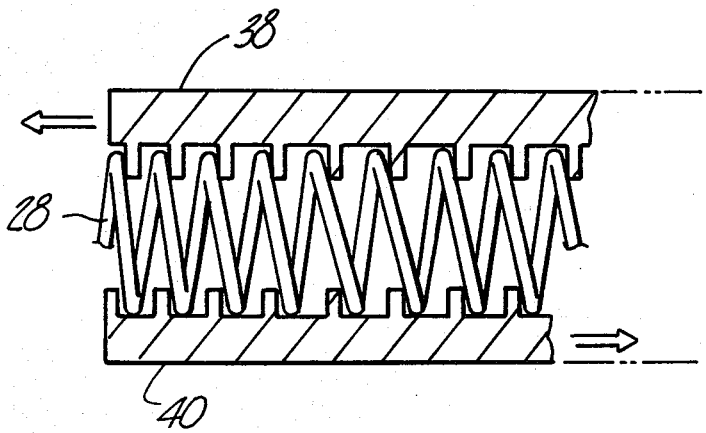
FIG. 4 is a diagrammatic representation of a portion of a helically wound tube in the process of carrying out the offsetting of the coiled tubes to produce the skewed coil.

As can be seen in FIG. 2, the skewed coil heat exchanger 28 differs from the coil sections 14 and 16 further in that each of the turns of the coil sections 34 and 36 has been axially offset on opposite sides thereof; that is, along the direction of air flow. This offset is produced by a relative displacement of the opposite points on each coil turn as indicated in FIG. 4.

A pair of tools 38 and 40 having a pitch equal to the pitch of the coiled tubing 28 are engage with the coil and are then relatively displaced to produce an offsetting of opposite portions of the coiled tubing 28. The points of engagement of the tools 38 and 40 are on the opposite sides across which the air flow is to occur, such that the intermediate or crossover portions 42 are increased in inclination with respect to the direction of air flow while the intermediate portions 44 of the coil windings are reduced or reversed, depending on the degree of skew of the reforming of the coiled tubing. Thus, the coil turn portions 42 are increased in obliqueness by being turned into the air flow which cause a greater proportion of the fins 22 to be exposed to the air flow in flowing across the coil sections 34 and 36.

The coil turn portions 44, depending on the degree of skew, may be reduced in inclination, unless the degree of offset is sufficient to create a reverse inclination from the original helix angle.

However, any such reduction in inclination has a relatively minor effect since at relatively steep angles, i.e., at angles of inclination relatively slightly inclined from the direction of air flow, a change in the angle is of much less effect on the degree of exposure of the fins 22 than the greatly increased exposure created by the much greater change in inclination of the portion 42. This is because there is a sine function relationship between the angle of inclination of the tubing with respect to the air flow direction and the extent of exposure of the radially inward fins 22. Since the angle of inclination is relatively steep, the relatively slight changes of inclination of the sections 44 have little effect in reducing the exposure of the fins on this portion of the coil turns.

This increase in inclination of section 42 also improves the angle of attack of the air flow in the sense that the direction of the air flow in passing through the fins 22 formed on portion 42 of the coil turn is more nearly transverse or across the fin array.

In addition, the fins attached to the section 42 are moved to a greater degree out of alignment along the direction of air flow with the tube sections 46 such that the fins 22 secured to the portions are much less subjected to shadowing by tube lead portions 46. The increased inclination also reduces the shadowing effect on the fins 22 in the array along the portion 42 of each winding.

With reference to FIGS. 5, 6 and 7, it may be further seen that the gaps 26 "seen" by the air flow across the coil, which were present in the conventionally wound coil intermediate successive windings, have been greatly reduced at the top or bottom of the coil by now being occupied by the crossover portions 42 of each winding. It can also be seen by reference to FIGS. 6 and 7 that a reverse winding of the coil sections 34 and 36 locates the crossover portion 42 at the top and bottom of the coil sections 34 and 36, respectively, such that there is substantially no gap remaining which is unoccupied by either tubing 12 or fins 22 in the array, as viewed from the direction of the air flow. Thus, the air cannot "see" through the coil sections 34 and 36, causing a reduction in the proportion of air flow passing through such openings without coming into the fin or tube surfaces of the heat exchanger.

The "herringbone" pattern created by the oppositely extending skew of the coil sections 34 and 36 tends to produce a longer flow path and a longer time duration of a given air mass within the heat exchanger since the flow is first directed at one inclination and thence in a reverse direction and at a greater inclination to the coil axis than a conventionally wound coil.

The overall envelope required to house the coil sections 34 and 36 is only modestly increased as the increased dimension is equal to only double the distance of offset of a single coil turn.

This increase in efficiency of heat transfer will thus allow either a reduced power consumption and overall efficiency of the unit or will allow the use of a smaller heat exchanger with fewer tubing turns.

Figure 8:
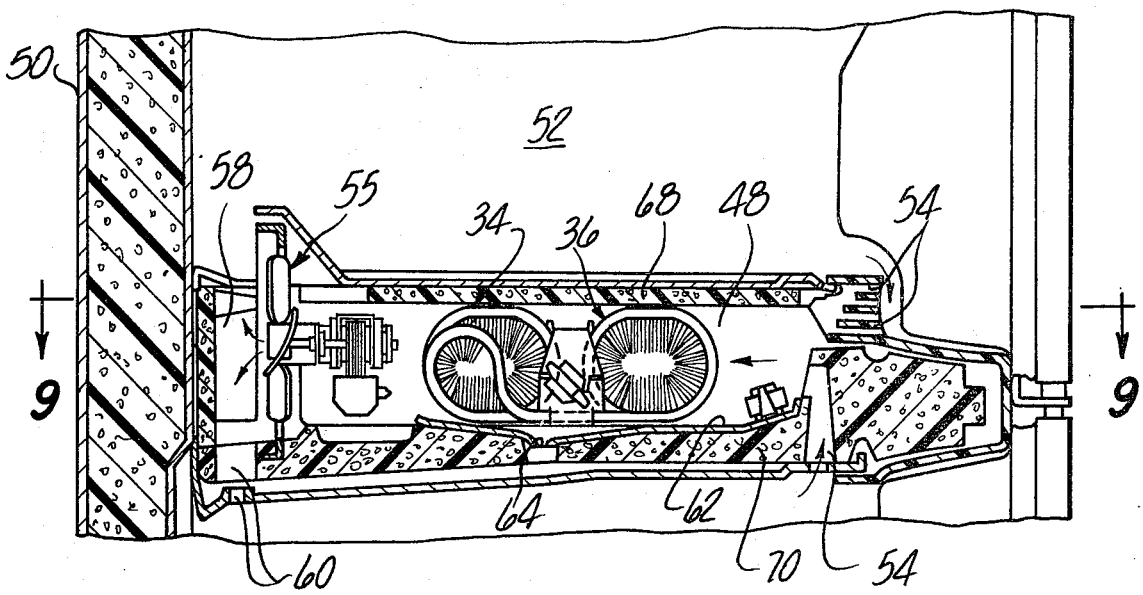
FIG. 8 is a partial vertical sectional view of a refrigerator showing the skewed coil evaporator according to the present invention in elevation.
Figure 9:
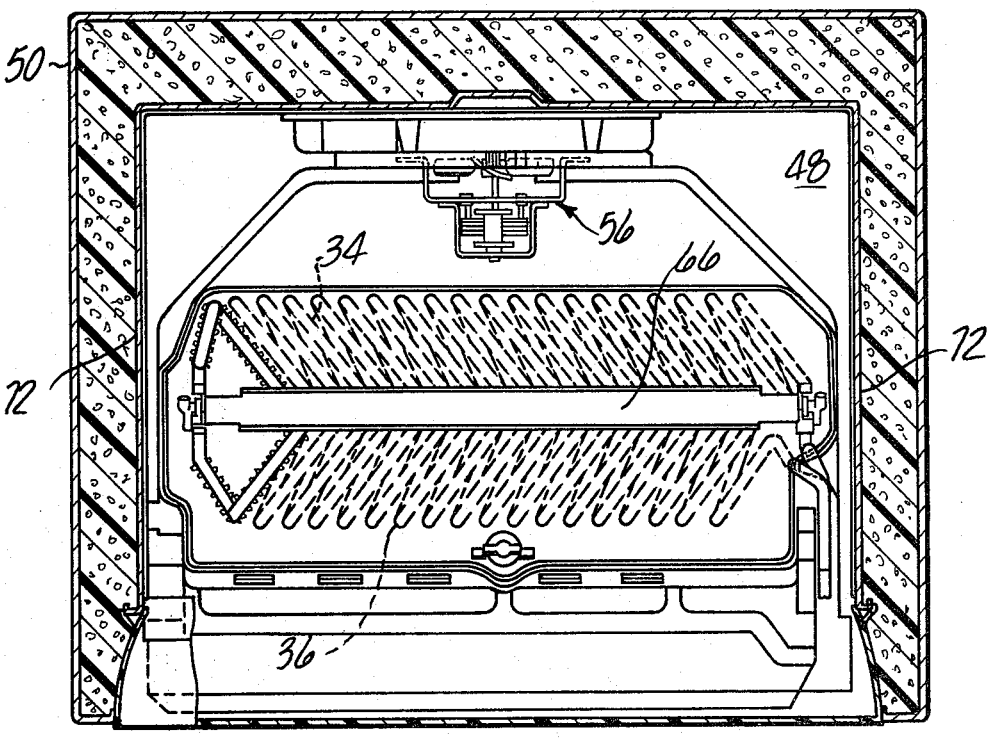
FIG. 9 is a partial horizontal sectional view of the refrigerator shown in FIG. 8 depicting the skewed coil evaporator in plan view.

Referring to FIGS. 8 and 9, the installation of the heat exchanger according to the present invention, into the evaporator chamber 48 of a refrigerator 50 is illustrated. The region above the evaporator chamber 48 is a food storage compartment of the refrigerator, the air within which is to be refrigerated to maintain the temperature of the storage compartment at the appropriate low temperature.

The air within the storage compartment 52 is drawn in through inlets 54 as shown, into the evaporator chamber 48. The air is drawn into the chamber 48 by means of a circulating fan 54 such that the air is drawn across the coil sections 34 and 36 in a direction across the axis of the coil tubes and thence recirculated into the refrigerator through outlet passages 58 and 60.

The coil sections 34 and 36 are positioned over a drain pan 62 which is adapted to collect water during the defrost cycle with a drain opening 64 provided to direct the water to a removable pan. A defrost heating element 66 is also provided for intermittent defrost cycles.

The evaporator chamber 48 is defined by upper walls 68, lower walls 70 and end walls 72 to confine the air flow and direct it across the coil sections 34 and 36 in a direction transverse to the axis of the coil sections 34 and 36. The coil sections 34 and 36 may be somewhat flattened as shown in FIG. 9 to provide a roughly elliptical shape in order to accommodate them to a relatively shallow chamber 48 dimension.

Accordingly, it can be seen that the offsetting of the opposite portions of each of the convolutions or turns of the coil sections 34 and 36 greatly improves the thermal contact of the air in passing over the coils and improves the mode of contact of the air flow with the heat exchanger in that a much larger proportion of the air flow comes into contact with the fin surfaces in the fin array. Further, the air in flow direction in passing over the fin array is in a more oblique direction to enhance the temperature differential maintained during the transfer of heat to thereby enhance the transfer of heat. In addition, the gaps between windings, which were present in the above-described conventionally wound helical coil, have been largely eliminated.

The reverse windings of the side-by-side coil sections 34 and 36 produces a longer time of contact of the air within the heat exchanger by increasing the length of the flow paths by reversely skewed coil turns and at the same time places the crossover portions of each loop on opposite sides of each other such as to eliminate aligned gaps in each coil section.

This improved efficiency has been achieved by a very simple manufacturing procedure, i.e., merely offsetting opposite portions of each of the coil windings, deforming the coil turns into an offset or skewed configuration. This increases the size of the coil, but modestly.

The shadowing effect has been greatly reduced by moving those portions of the coil turns directly behind the leading coil turn portions ahead of the crossover section such as to provide greater contact of the air with the portions of the fin array which were shadowed by the prior art design.

The particular skew angle or offset depends on the spacing of the coils and the degree of clearance required for the fin array to prevent ice bridging. That portion of the coil winding which is reduced in inclination is displaced to be nearly parallel or reversely inclined with respect to the air flow direction. This will produce an angle of inclination of the turn portions 42 at an angle of 20° to 30° from the direction of air flow, i.e., normal to the coil axis. However, any degree of offset will improve the efficiency of the unit.

The heat exchanger of the present invention is particularly adapted to refrigerator evaporator coils in which air is cooled by passing it over a tubing condensed refrigerant which is allowed to vaporize in the evaporator coils and thus to absorb heat from the air. This is because this heat exchanger configuration resists ice bridging and may be manufactured at low cost.

However, the invention is not limited to such application and may be utilized for either the heating of fluids, as well as the cooling of fluids, between a first fluid circulated within the tubing and a second fluid which is directed over the coil, with the second fluid directed over the coil windings in a direction transverse to the coil axis.

It is noted that the skewed coil configuration produces a coil turn in which portions of the turn extend at variable helix angles, such that portions of each turn are inclined to the air flow direction (normal to the coil axis) at varying degrees of obliqueness.

Hence, the offsetting described is in the sense that the portions of the coil turns are displaced from their positions assumed during forming of conventionally constant helix angle coils. As noted, conventionally wound coils are wound at constant helix angles such that for a given number of turns or coil spacing, there is a "natural" helical angle and the turns of the coil advance at this inclination with respect to the axis of the coil.

The present invention lies in the offsetting of opposing portions of each turn along the direction of air flow such as to skew these portions from the "natural" helical angle of the coil and produce turn portions varying from the helix angle, one of which is inclined at increased obliquity to that angle, the other portion being moved such that the adjacent section is reduced or reversed in inclination.

The embodiments of the invention in which an exclusive property or privilege is claimed are defined as follows:

1. A heat exchanger comprising:

a tube wound into generally helical coil, each of the turns in said coil being spaced apart and skewed at variable helical angles through each of said turns to present portions of each of said turns at varying degrees of obliqueness to a direction transverse to said coil axis;

a fin array comprising fins secured to said tube along the length thereof and extending in the general direction of the radius of said coil turns at the point whereat each of said fins is secured to said tube;

means for directing fluid through said coil in said transverse direction across said coil axis whereby increased fluid flow contact with said fin array is achieved by said skewing of said turns into the path of said fluid flow.

2. The heat exchanger according to claim 1 wherein said skewing of said portions of each of said coil turns comprises opposite portions of each of said turns offset from the natural helical angle of said coil and wherein said portions are located along the direction of said fluid flow across said coil.

3. The heat exchanger according to claim 2 wherein said radially extending fins extend inwardly from said coiled tube winding.

4. The heat exchanger according to claim 3 wherein said coil comprises first and second coil sections positioned in side-by-side relationship and wherein said fluid flow is directed across both of said first and second coil sections.

5. The heat exchanger according to claim 4 wherein each of said first and second coil sections is wound in an opposite direction, whereby the crossover sections of each of said coil turns are positioned on opposite sides of said respective coil sections.

6. The heat exchanger according to claim 4 wherein said offset portions of said coil turns extend in opposite directions in each of said coil sections, whereby said coils are in side-by-side relationship and form a herringbone pattern.

7. A refrigerator evaporator unit comprising:

an evaporator including a helically coiled tube having a plurality of axially spaced coil turns, said tube having a plurality of radially inward extending fins formed along its length; means for directing air flow over said coil in a direction substantially normal to the axis of said coil;

said coil turns being skewed from the natural helix angle of said coil windings, said skew turning portions of said coil windings into said air flow over said coil;

whereby a greater proportion of said radially inwardly extending fins is disposed in said air flow by said skewing from said natural helix angle.

8. A refrigerator including:

an evaporator chamber having an air inlet adjacent one end thereof and an air outlet adjacent the other end;

an evaporator in said chamber, said evaporator comprising a tube helically coiled, said evaporator further including a fin array comprising fins extending radially inward of said tube coils formed along the length of said tube;

said tube coil turns being spaced apart and each having portions thereof axially offset from one another from the natural helix angle of said coil;

whereby one of said portions is at an increased inclination to said coil axis from said natural helix angle; said evaporator positioned in said chamber whereby said air flow is directed across said coil in a direction transverse to said coil axis and is located along the direction of said air flow coil turn portions which are turned into said air flow by said axial offsetting.

9. The refrigerator according to claim 8 wherein said evaporator coil tubing comprises a first and second coil section in side-by-side relationship in said evaporator chamber, said first and second coil sections being disposed in said chamber whereby said air flow is directed first across one of said sections and then across a second one of said coils, and wherein said respective first and second coil sections are wound in opposite directions, said coil sections being skewed in opposite directions by said offset portions of each of said first and second coil section turns.

* * * * *